United States Patent [19]

Werner et al.

[11] 4,394,344

[45] Jul. 19, 1983

[54] HEAT PIPES FOR USE IN A MAGNETIC FIELD

[76] Inventors: Richard W. Werner, San Ramon; Myron A. Hoffman, Davis, both of Calif., granted to U.S. Department of Energy under the provisions of 42 U.S.C. 2182

[21] Appl. No.: 258,818

[22] Filed: Apr. 29, 1981

[51] Int. Cl.[3] ..... F28D 15/00

[52] U.S. Cl. ..... 376/146; 165/104.26; 165/1; 376/367; 310/11; 310/54; 310/57

[58] Field of Search ..... 376/146, 367; 165/104.26, 1; 310/11, 54, 57

[56] References Cited

PUBLICATIONS

R. W. Womer, *A Vacuum Wall Free Blanket Using Heat Pipes,* Lawrence Radiation Lab., Univ. of Calif., Livermore, Calif., 8/13/1969, UCRL-71758.

G. A. Carlson et al., *Effect of Magnetic Fields on Heat Pipes,* Lawrence Radiation Lab., Univ. of Calif., Livermore, 12/31/1969, UCRL-72060.

*Primary Examiner*—Albert W. Davis, Jr.

*Attorney, Agent, or Firm*—L. E. Carnahan; Roger S. Gaither; Richard G. Besha

[57] ABSTRACT

A heat pipe configuration for use in a magnetic field environment of a fusion reactor. Heat pipes for operation in a magnetic field when liquid metal working fluids are used are optimized by flattening of the heat pipes having an unobstructed annulus which significantly reduces the adverse side region effect of the prior known cylindrically configured heat pipes. The flattened heat pipes operating in a magnetic field can remove 2—3 times the heat as a cylindrical heat pipe of the same cross sectional area.

10 Claims, 4 Drawing Figures

HEAT PIPES FOR USE IN A MAGNETIC FIELD

BACKGROUND OF THE INVENTION

The invention described herein arose at the Lawrence Livermore National Laboratory under Contract No. W-7405-ENG-48 between the U.S. Department of Energy and the University of California.

The invention is directed to heat pipes, particularly to a heat pipe in a magnetic field environment, and more particularly to a heat pipe configuration for operation in a magnetic field when liquid metal working fluids are used.

Of the various means of transmitting heat, the heat pipe is, in many respects, the most satisfactory. Among the many outstanding advantages of using the heat pipe as a heat transmission device are: constructional simplicity, exceptional flexibility, accessibility to control, and ability to transport heat at a high rate over considerable distance with extremely small temperature drop. Moreover, heat pipes require no external pumping power.

In its conventional form, the heat pipe is a closed tube or chamber of different shapes whose inner surfaces are lined with a porous capillary wick. The wick is saturated with the liquid phase of a working fluid and the remaining volume of the tube contains the vapor phase. Heat applied at the evaporator section by an external source vaporizes the working fluid in that section. The resulting difference in pressure drives vapor from the evaporator section to the condenser section where it condenses, releasing the latent heat of vaporization to a heat sink in that section of the pipe. Depletion of liquid by evaporation causes the liquid-vapor interface in the evaporator section to enter into the wick surface and a capillary pressure is developed there. This capillary pressure pumps the condensed liquid back to the evaporator section for reevaporation. That is, the heat pipe can continuously transport the latent heat of vaporization from the evaporator section to the condenser section without drying out the wick. This process will continue as long as the flow passage for the working fluid is not blocked and a sufficient capillary pressure is maintained.

Heat pipes have been developed with working fluids ranging from cryogenic liquids to liquid metals, and have been categorized by the operating temperatures or normal boiling points of the working fluids. For example, the liquid-metal type heat pipes are those having an operating temperature of 670° F. (628 K.) or above. Working fluids such as mercury, cesium, potassium, sodium, lithium, and silver have boiling points above 670° F. at 1 atmosphere pressure. Also, it has been observed for most fluids that properties relevant to heat-pipe performance are maximum in the vicinity of the fluids' normal boiling points.

The purpose of a wick in a heat pipe is to provide: (1) the necessary flow passages for the return of the condensed liquid; (2) surface pores at the liquid-vapor interface for the development of the required capillary pumping pressure; and (3) a heat-flow path between the inner wall of the container and the liquid-vapor interface. Mesh screen, fiberglass, sintered porous metal, and narrow grooves cut in the inner surface of the container wall have been used as wick materials. Generally, an effective wick structure requires small surface pores for large capillary pressure, large internal pores for minimal liquid-flow resistance, and an uninterrupted highly conductive heat-flow path across the wick thickness for a small temperature drop. Because of these requirements, many types of wick structures have been developed. They have been classified into two general classes, namely: homogeneous wicks and composite wicks. The homogeneous wicks are made of a single material and the composite wicks consist of two or more materials. The wick configurations have been generally classified as classical, channeled, and clear annulus. In the classical wick, the wick is in abutment with the inner surface of the container or tube; while in the channeled wick, it is positioned away from the container inner surface, but interconnected thereto by a plurality of channel-forming members. The clear annulus wick is positioned in spaced relation with respect to the inner surface of the tube or container and is supported by a minimal number of supports.

While the basic construction, operation, and configuration of heat pipes have been set forth above, a more complete description thereof can be found, for example, in the text "Heat Pipe Theory and Practice—A Sourcebook" by S. W. Chi, The George Washington University, published by McGraw-Hill Book Company, 1976.

Heat pipes have been proposed for use in environments where there are strong magnetic fields such as in fusion reactors. The presence of a magnetic field can influence the performance of a heat pipe significantly, depending on the heat-pipe geometry, its orientation in the magnetic field, the heat-pipe material and fluid properties, as well as the magnetic field strength. It has been shown that a magnetic field affects the performance of a heat pipe most strongly when a component of the field is perpendicular to the heat-pipe axis and an electrically conducting fluid is used along with a metallic wick structure.

In the prior efforts directed to heat pipes in a magnetic field environment, liquid-metal heat pipes employing a compound wick structure were considered, as well as the so-called conventional heat pipe having a simple wick structure. Such prior efforts are exemplified in "The Module Approach to Blanket Design—A Vacuum Wall Free Blanket Using Heat Pipes," R. W. Werner, Proceedings of the International Conference on Nuclear Fusion Reactors, Culham, England, 1969; "Effect of Magnetic Fields on Heat Pipes," G. A. Carlson and M. A. Hoffman, UCRL-72060, December 1969 (ASME Paper No. 70-HT/Spt-10); and "Heat Pipes in the Magnetic-Field Environment of a Fusion Reactor," G. A. Carlson and M. A. Hoffman, Transactions of the ASME, August 1972, pp. 282–288.

While substantial effort has been directed to utilizing the efficiency of heat pipes for heat transmission in magnetically confined fusion reactors, a need has existed for a method or means of overcoming the problem associated with the adverse effect on heat pipes by magnetic fields, as pointed out above, particularly when a component of the field is perpendicular to the heat pipe axis.

SUMMARY OF THE INVENTION

An object of the invention is to provide a heat pipe for use in a magnetic field.

A further object of the invention is to provide a heat pipe for operation in a magnetic field utilizing a liquid metal working fluid at high temperature.

A still further object of the invention is to provide a heat pipe having a flattened configuration and an unobstructed liquid flow channel for use in a magnetic field environment which thereby decreases the pressure drop caused by the magnetic field.

Another object of the invention is to provide a flattened heat pipe which has the capability of removing two-to-three times the heat as a round heat pipe of the same cross-sectional area when operating in a magnetic field.

Another object of the invention is to provide a method of obtaining substantially greater heat transmission by positioning a heat pipe, having a flattened configuration and an unobstructed liquid flow passage formed by the wick, in a magnetic field such that the magnetic pressure drop is reduced and the adverse effects of the side regions of the heat pipe are virtually eliminated.

Another object of the invention is to provide a method of decreasing the magnetic pressure drop and eliminate the adverse effects of the side regions of a heat pipe in a magnetic field by utilizing a heat pipe having a flattened configuration so as to define an unobstructed liquid flow channel.

Other objects of the invention will become apparent from the following description and accompanying drawings.

The objects of this invention are carried out by the recognition that the efficiency of operation of a heat pipe can be substantially increased (two-to-three times) by flattening a round heat pipe using a wick which forms a substantially unobstructed liquid flow channel and which results in substantially eliminating the adverse effects caused by side regions of a round heat pipe when placed in a magnetic field perpendicular to the heat pipe axis and parallel to the flat faces of the heat pipe.

The invention involves a method and apparatus for increasing the heat transfer of a heat pipe operating in a magnetic field, such as in a magnetic confinement fusion reactor, by utilizing annular liquid flow channel-type heat pipes having a flattened configuration. By elimination of the adverse effects produced by the side regions of a round heat pipe when operating in a magnetic field perpendicular to the heat pipe axis, the heat pipe of this invention can remove ~2–3 times the heat as that of a round (cylindrical) heat pipe of the same cross sectional area.

DETAILED DESCRIPTION OF THE INVENTION

The invention is directed to a method and apparatus for substantially improving the heat transmission of a heat pipe operating in a magnetic field. The invention involves a flattened heat pipe having its longitudinal axis perpendicular to a magnetic field and its flattened faces parallel to the field such that the adverse effects caused by the side regions of the cylindrical heat pipe is substantially reduced or eliminated, thus decreasing the magnetic pressure drop. It has been determined by preliminary calculations that the heat pipe of the invention can remove ~2–3 times more heat than a round (cylindrical) heat pipe of the same cross sectional area when placed in a magnetic field perpendicular to the axis of the heat pipes.

Figure 3:
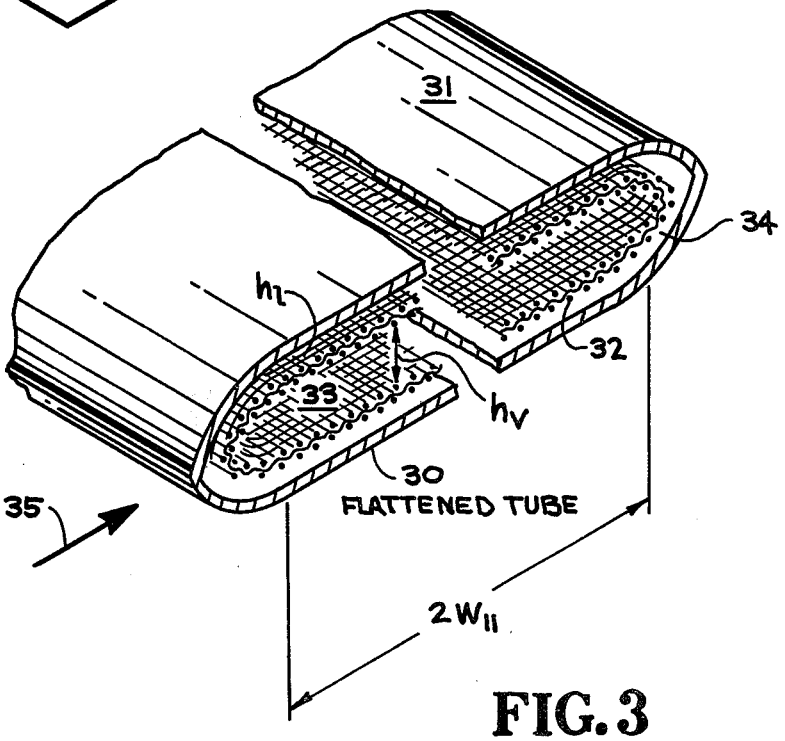
FIG. 3 is an enlarged cross sectional end view of a heat pipe operating in a magnetic field in accordance with the invention.

While the preferred embodiment of the invention illustrated in FIG. 3 utilizes an annular type liquid flow channel formed by a wick so as to provide substantially unobstructed liquid flow, the invention is not limited to this embodiment, but can be utilized with other types of wick structures known in the art.

Figure 1:
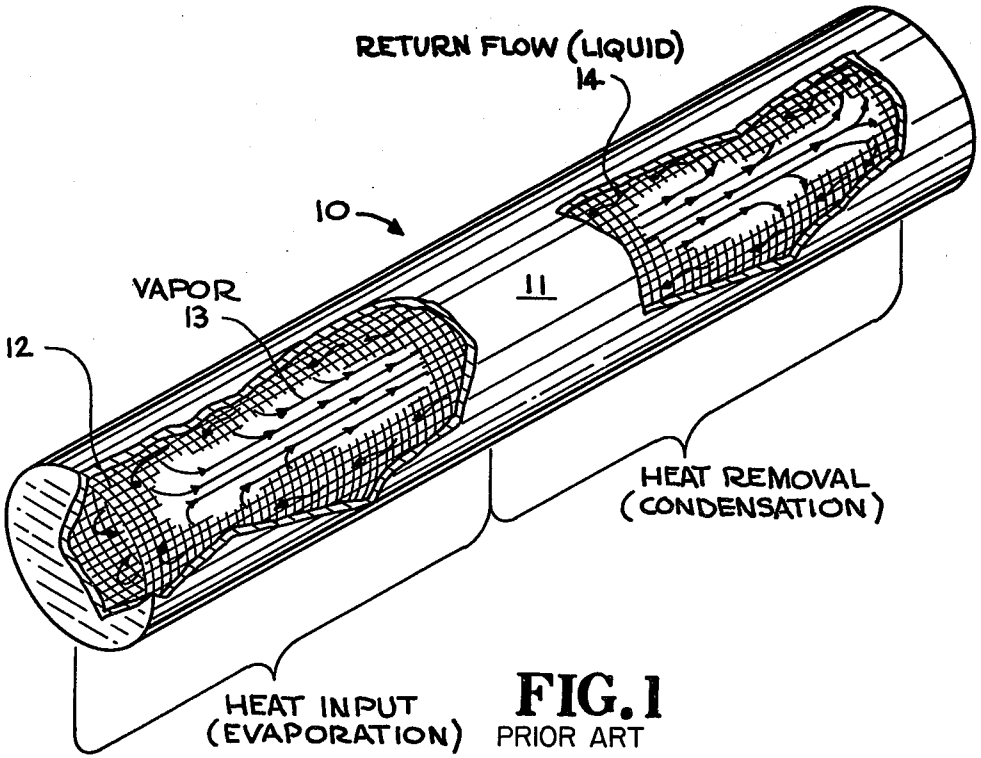
FIG. 1 PRIOR ART
FIG. 1 illustrates a cylindrical heat pipe with portions cut away to show the wick thereof.

As pointed out above, the general structure and operation of heat pipes are well known in the art, and thus a detailed description of such is deemed unnecessary. FIG. 1 illustrates a typical cylindrical heat pipe generally indicated at 10 consisting basically of a tube or container 11 having a wick 12 mounted therein. In this embodiment the wick 12 is of a woven structure positioned in spaced relation with respect to the inner surface of the tube 11. The heat pipe 10 may be separated into three sections: the heat input (evaporation) section, an adiabatic section, and the heat removal (condensation) section, with only the evaporation and condensation sections being indicated by legends. In operation the vapor 13 flows within the volume surrounded by the wick 12 in one direction, as indicated by the flow arrows, while the return flow (liquid) 14 is in an opposite direction within the wick 12 and within the inner volume of the tube 11 between the wick and the tube inner wall, as indicated by the flow arrows.

Figure 2:
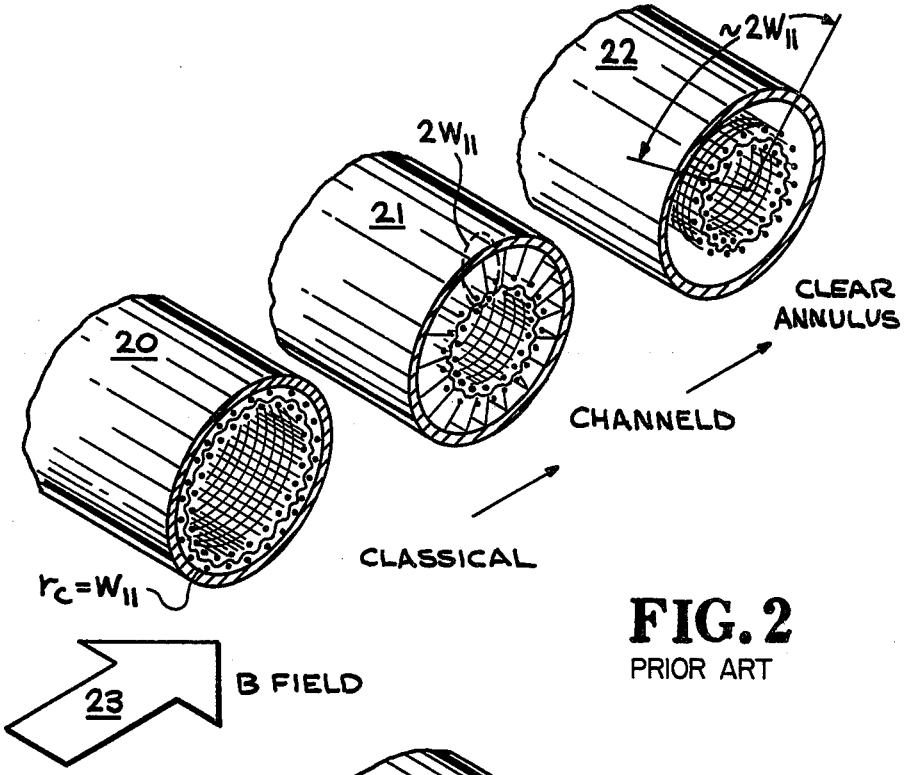
FIG. 2 PRIOR ART
FIG. 2 is a view illustrating cylindrical prior art types of heat pipes operating in a magnetic field.

To more clearly illustrate the present invention, which involves modifications to the structural shape and to the arrangement of liquid and vapor flow passages of a conventional cylindrical or round heat pipe so as to increase the heat transfer by 2–3 times when operating in strong magnetic fields, reference is now made to FIGS. 2 and 3. The nomenclature for the following description is set forth in Table 1. FIG. 2 illustrates three types of cylindrical heat pipes: classical, indicated at 20; channelled, indicated at 21; and clear annulus, indicated at 22; with a magnetic field 23 being directed perpendicular to the axis of the heat pipes 20–22.

In a classical heat pipe (see pipe 20 of FIG. 2), evidenced as a long tubular structure where the length $l >>$ tube diameter d, and the wicking structure is a screen-like material laid up against the inner wall of the tube, the pressure drop in the liquid flow is determined by $r_c$, the pore size of the capillary wick. That is to say, the liquid flow channel geometry is the same as the capillary wick geometry. A small value of $r_c$ is very critical for good capillary pumping. This is illustrated in the following equation for a classical heat pipe operating in a magnetic field in the gravity-assisted mode:

$$\underset{(1)}{\Delta P_c} + \underset{(2)}{\Delta P_G} \geqq \underset{(3)}{\Delta P_v} + \underset{(4)}{\Delta P_l} + \underset{(5)}{\Delta P_M}$$

or

| Pressure rise due to capillary forces | + | Pressure rise due to gravity | ≧ | Pressure drop in vapor flow | + | Pressure drop in liquid due to viscous forces | + | Pressure drop in liquid due to magnetic field |
|---|---|---|---|---|---|---|---|---|
| (1) | | (2) | | (3) | | (4) | | (5) |

The expanded equation is as follows:

$$\left(\frac{2\gamma\cos\theta}{r_c}\right) + (\rho g l \sin\phi) \geqq \left(\frac{\left(1-\frac{4}{\pi^2}\right)Q^2}{8\rho_v r_v^4 L^2}\right) +$$

(1) (2) (3)

$$\left(\frac{b\eta_l Q l'}{2\pi\,(r_w^2 - r_v^2)\,\rho_l e \cdot r_h^2 L}\right) +$$

(4)

$$\left(\left(H + \left(\frac{H^2 C}{1+C}\right)\right)\frac{Q\eta_{el}'}{2\pi\rho_2\,(r_w^2 - r_v^2) w_{\|}^2 L\, e}\right)$$

(5)

If the classical heat pipe geometry is used, the dimension $r_c$ plays a dual role since $r_c = r_h = w_{\|}$. First, in order to provide maximum capillary pumping, we would like to make the value of $r_c$ a minimum. However, as $r_c$ is decreased, the effect is to increase the viscous drag in the liquid in inverse proportion to $r_c^2$. The magnetic pressure drop is also adversely affected, primarily through the effective wall conductance ratio $C \approx \sigma_w t_w / \sigma_e w_{\|}$, when metallic wicks and walls are used.

It is important to recognize that the only place $r_c$ must be retained for capillary pumping is at the interface between liquid and vapor. Therefore, in the liquid flow region leading to the capillary, the dimensions of the flow channel can be independent of $r_c$ and can take on whatever values produce the best heat pipe. One of the proposed geometries is the channelled heat pipe (see pipe 21 of FIG. 2) where slots are provided for liquid flow and the screen or wick now lies on top of the channel dividers. The characterizing dimension in a channelled heat pipe for the liquid pressure drop is now determined by $2w_{\|}$ of the small channels, while $r_c$ of the screen still governs the capillary pumping pressure term. When the size and location of these liquid channels were optimized so as to minimize detrimental effects from the magnetic field, substantial improvement in performance was predicted for a channelled heat pipe operating in a magnetic field.

Recently, it has been determined that improvements (particularly for the B field effects) were potentially possible by substituting a clear, unobstructed annular space (see pipe 22 of FIG. 2) in place of the individual channels within the annulus. The idea of using an annular liquid return channel was investigated many years ago to help reduce the ordinary liquid viscous pressure drop. In the presence of a magnetic field, the effect of the unobstructed annulus can be even more dramatic. The critical dimension, $2w_{\|}$, in the magnetic pressure drop term which we wish to maximize increases significantly. It is estimated to be on the order of $\pi d/4$ in the top and bottom regions of the round heat pipe (see pipe 22 of FIG. 2). However, the magnetic field would still severely retard the liquid flow in the side regions where the effective $2w_{\|}$ is still small. Unfortunately, the liquid flow channels in these side regions cannot simply be eliminated when the heat pipe is used in applications where there is heating all around the perimeter.

With the information described above with respect to the cylindrical heat pipes of FIG. 2, it being recognized that the important dimension in the magnetic pressure drop was $w_{\|}$, it was discovered that if the round tube was flattened, as illustrated in FIG. 3, the flattening process would cause $2w_{\|}$ to become very large and would virtually eliminate the side regions decreased above with respect to pipe 22 of FIG. 2.

With reference to the invention as illustrated in FIG. 3, the important magnetic pressure drop term now becomes:

$$\left(-\frac{dp}{dx}\right)_M = \left(H + \frac{H^2 C}{1+C}\right)\frac{\eta_l \bar{u}}{w_{\|}^2} \text{ (for } H > 10)$$

$$\text{where } H \equiv w_{\|} B \sqrt{\frac{\sigma_l}{\eta_l}}$$

and where C′ can be less than the classical C defined as:

$$C \equiv \sigma_w t_w / \sigma_e w_{\|}$$

For small C′, $$\frac{C'}{1+C'} \longrightarrow C$$

$$\therefore \left(-\frac{dp}{dx}\right)_M \simeq \left[\frac{B}{w_{\|}}\sqrt{\frac{\sigma_l}{\eta_l}} + B^2\frac{\sigma_l}{\eta_l} \times C'\right]\eta_{el} \cdot \bar{u}$$

The effective wall conductance ratio, C′, is a complex function of the geometry and electrical conductivities of the wall and screen material and the liquid metal working fluid for the flat heat pipe. Preliminary estimates indicate that for the case where $C\sqrt{H} > 1$, C′ may be as low as the following:

$$C' \approx (\text{constant}) \times C(w_{\perp}/w_{\|})$$

where the constant is on the order of 2 to 3.

For the case where $C\sqrt{H} << 1$, preliminary estimates indicate that C′ may approach the following low value:

$$C' \longrightarrow (\text{constant}) \times \frac{w_{\perp}}{w_{\|}\sqrt{H}}$$

where the constant here is on the order of 3 to 4. In both cases, C′ can be made much less than the classical C by making $w_{\|} >> w_{\perp}$.

TABLE 1

| Nomenclature | | |
|---|---|---|
| $\gamma$ | = | surface tension, N-m |
| $\rho_l$ | = | liquid density, kg/m$^3$ |
| $\rho_v$ | = | vapor density, kg/m$^3$ |
| g | = | grav. term, m/s$^2$ |
| $r_c$ | = | capillary radius, m |
| l | = | heat pipe length, m |
| l′ | = | effective length, m |
| $\theta$ | = | contact angle of the liquid meniscus |
| $\phi$ | = | angle of inclination from horizontal |
| Q | = | energy flux, axial, W/m$^2$ |
| L | = | latent heat of vaporization, J/kg |
| $\eta_l$ | = | liquid viscosity, Ns/m$^2$ |
| u | = | average velocity, m/s |
| $w_{\|}$ | = | half channel width parallel to magnetic field, m |
| $w_{\perp}$ | = | half channel width perpendicular to magnetic field, m |
| B | = | magnetic field, Telsa |

TABLE 1-continued

| Nomenclature | | |
|---|---|---|
| $\sigma_l$ | = | electrical conductivity of fluid, mhos/m |
| $\sigma_w$ | = | electrical conductivity of tube wall, mhos/m |
| H | = | Hartmann number |
| C | = | conductance ratio |
| e | = | unobstructed liquid flow area fraction |
| b | = | constant determined by liquid flow geometry |
| $r_h$ | = | half the hydaulic diameter of the liquid flow channel |
| $r_w$ | = | inside radius of tube, m |
| $r_v$ | = | radius of vapor flow conduct, m |

The flattened tube, clear annulus embodiment of the heat pipe of this invention, as illustrated in FIG. 3 and generally indicated at 30, consists of a flattened or elongated cross sectional tube or container 31 having a wick structure 32 defining a chamber 33 therein, wick 32 being mounted in spaced relation with tube 31 to define an unobstructed flow channel 34 therebetween. A magnetic or electromagnetic radiation field, indicated at 35 from a source not shown, is directed perpendicular to tube 31 but parallel to the flattened faces or sides of tube 31. The operation of the FIG. 3 heat pipe 30 is generally similar to that described above with respect to FIG. 1, except that the adverse effects of the side regions described above with respect to FIG. 2 are substantially reduced.

By way of example, the embodiment of the invention illustrated in FIG. 3 may be constructed of the following materials and parameters: tubing 31 made of steel alloys, such as 304 stainless steel, or refractory metals, such as niobium, with a wall thickness of 0.5 mm to 2.0 mm, and an internal cross sectional area of 2 $cm^2$ to 20 $cm^2$; wick structure 32 being constructed of steel alloys or refractory metals in the form of a weave mesh or wire having a capillary radius of 0.01 mm to 0.1 mm; and flow channel 34 height being in the range of 1.0 mm to 6.0 mm. The magnetic field 35 may have a strength of near 0 to 10 tesla. The distance or height $h_v$ of the vapor chamber 33 (see FIG. 3) relative to the distance or height $h_L$ of liquid annulus 34 may be established by the equation:

$$h_V \cong 2w_v \cong 2w_\perp \rightarrow 10W$$

where $$2w_\perp = h_L.$$

Also:

$$2w_{||} \gtrsim 10(2w_\perp)$$

To illustrate the advance provided by the flattened or elongated heat pipe of this invention compared to a cylindrical heat pipe such as pipe 22 of FIG. 2 positioned in a magnetic field of 2 tesla having a cross sectional area within the tube of ~3 $cm^2$ so as to provide a vapor chamber radius of 8 mm, using a wick structure of 0.1 mm capillary radius and with liquid flow channel or gap between the tube and wick of 2 mm, using liquid metal, such as sodium, as the working fluid at its boiling point, the heat removed from the heat pipe of FIG. 2 is ~2 $KW/cm^2$. By comparison, with a similarly constructed heat pipe, but of a flattened configuration as in FiG. 3, the heat removed is ~4–6 $KW/cm^2$. Thus, it is readily seen that the flattened heat pipe of this invention, when utilized in a strong magnetic field perpendicular to the longitudinal axis of the heat pipe, substantially increases the heat removed, thus greatly increasing the efficiency of the heat pipe.

Figure 4:
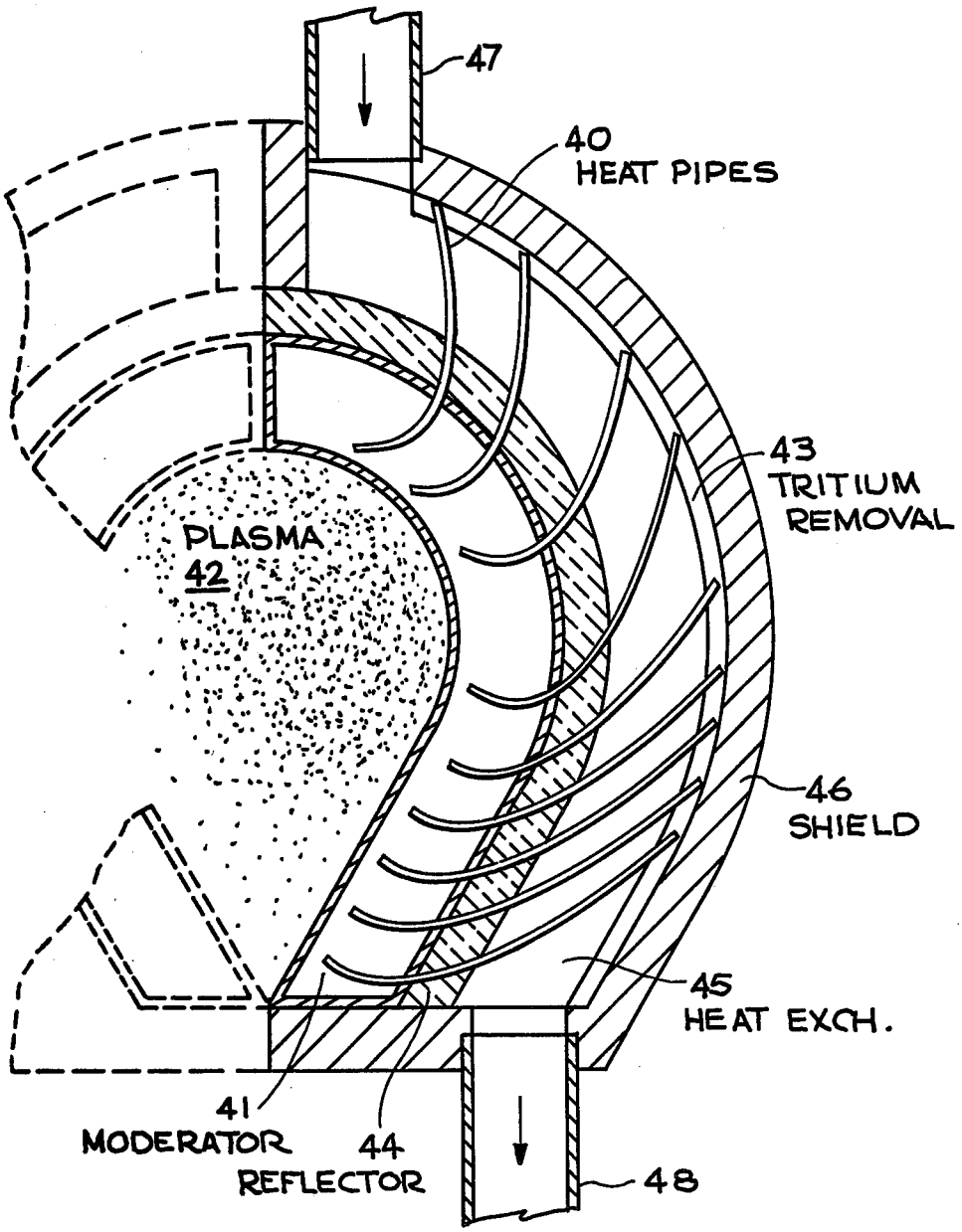
FIG. 4 is a schematic view of a heat pipe blanket module in a magnetic confinement fusion reactor.

FIG. 4 schematically illustrates a magnetic confinement fusion reactor utilizing the flattened heat pipes of the present invention in a blanket module. In this embodiment, the heat pipes 40 extend from moderator 41, which surrounds a magnetically confined plasma 42, to a tritium removal blanket 43, and pass through reflector 44 and heat exchanger 45, blanket 43 being surrounded by a shield 46. A heat exchange medium is directed through inlet 47 past heat exchanger 45 and discharged through outlet 48, as indicated by the flow arrows. In the FIG. 4 embodiment, by way of example, the plasma confinement area 42 has a radius of at least 1.5 M, the moderator 41 a thickness of 1 M, reflector 44 a thickness of 0.35 M, with shield 46 having a thickness of 0.35 M. Note that heat pipes 40 are curved to reduce neutron leakage.

It has thus been shown that the present invention provides a heat pipe, particularly adapted for use with a magnetic field, and using liquid metal as the work fluid. The flattened configuration of the heat pipe of the invention increases the heat removal capability by 2–3 times over that of a cylindrical heat pipe of the same cross sectional area. This substantial increase in heat removal results from the elimination or substantial reduction of the adverse effects of the side regions created by the cylindrical heat pipe when the pipe is positioned in a magnetic field perpendicular to the axis of the pipe.

While a specific embodiment of the invention has been illustrated and described, modifications will become apparent to those skilled in the art, and it is intended to cover in the appended claims all such modifications as come within the scope of the invention.

What we claim is:

1. A method for decreasing magnetic pressure drop and increasing heat removal of a heat pipe having at least a portion thereof positioned in a magnetic field perpendicular to the heat pipe, comprising the steps of: providing the heat pipe having a container and wick so as to have an elongated cross section, and positioning the heat pipe such that the smallest distance across the cross section is substantially perpendicular to the magnetic field.

2. The method of claim 1, wherein the heat pipe is provided with the wick in spaced relation to an inner surface of the container so as to form a substantially unobstructed channel therebetween.

3. The method of claim 1, wherein the heat pipe is provided so as to define a first distance parallel to the magnetic field, and a second distance perpendicular to the magnetic field, said first distance being greater than said second distance.

4. A heat pipe in combination with a magnetic field perpendicular to the longitudinal axis of the heat pipe, said heat pipe having a cross section wherein a first distance is greater than a second distance, said first distance being substantially parallel to said magnetic field, and said second distance being substantially perpendicular to said magnetic field, whereby magnetic pressure drop across said heat pipe is decreased while in the magnetic field.

5. The heat pipe of claim 4, including a container and a wick structure, said wick structure being located in said container so as to provide a substantially unrestricted channel therebetween.

6. The heat pipe of claim 5, additionally including a liquid metal as a working fluid in the heat pipe.

7. The heat pipe of claim 6, wherein said wick structure is constructed of interwoven material.

8. In a magnetic confinement reactor having at least one heat pipe for transferring heat and positioned so that a longitudinal axis of the heat pipe is perpendicular to a magnetic field, the improvement comprising: a heat pipe constructed to decrease magnetic pressure drop thereacross and having a cross section with a first distance greater than a second distance, said first distance being substantially parallel to said magnetic field and said second distance being substantially perpendicular to said magnetic field, whereby a magnetic pressure drop across the heat pipe is decreased.

9. The improvement of claim 8, wherein said heat pipe includes a container and a wick, said wick being located in spaced relation within said container.

10. The improvement of claim 8, wherein said heat pipe is provided with liquid metal as a working medium therein.

* * * * *